US007005081B2

(12) United States Patent
Kawase et al.

(10) Patent No.: US 7,005,081 B2
(45) Date of Patent: Feb. 28, 2006

(54) BASE MATERIAL CUTTING METHOD, BASE MATERIAL CUTTING APPARATUS, INGOT CUTTING METHOD, INGOT CUTTING APPARATUS AND WAFER PRODUCING METHOD

(75) Inventors: Nobuo Kawase, Kanagawa (JP); Masakatsu Ohta, Tokyo (JP); Nobuyoshi Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 594 days.

(21) Appl. No.: 10/188,931

(22) Filed: Jul. 3, 2002

(65) Prior Publication Data

US 2003/0022508 A1 Jan. 30, 2003

(30) Foreign Application Priority Data

Jul. 5, 2001 (JP) ..... 2001-205315
Jul. 5, 2001 (JP) ..... 2001-205316

(51) Int. Cl.
*H01L 21/00* (2006.01)

(52) U.S. Cl. ..... 216/63; 216/58; 216/65; 438/460; 438/463; 438/708

(58) Field of Classification Search ..... 216/63, 216/58, 65; 438/460, 463, 708; 219/121.67
See application file for complete search history.

(56) References Cited

U.S. PATENT DOCUMENTS 5,912,186 A * 6/1999 Yoshino et al. ..... 438/708
5,990,497 A * 11/1999 Kamakura et al. ..... 257/94
6,058,498 A * 5/2000 Nagasaki et al. ..... 714/752

FOREIGN PATENT DOCUMENTS

JP 9-141645 6/1997

* cited by examiner

*Primary Examiner*—Shamim Ahmed
(74) *Attorney, Agent, or Firm*—Morgan & Finnegan, L.L.P.

(57) ABSTRACT

This invention discloses an ingot cutting apparatus, wherein a crystalline ingot is positioned within an etching gas and a component of the etching gas is excited by illumination of light from a light source onto the crystalline ingot, thereby making a component of the etching gas react chemically with the component of the crystalline ingot and volatilizing the component of the crystalline ingot to cut the crystalline ingot and obtain wafers and wherein light from a light source is guided to the crystalline ingot via a sheet-like, bar-like, or fiber-like optical wave guide.

5 Claims, 17 Drawing Sheets

BASE MATERIAL CUTTING METHOD, BASE MATERIAL CUTTING APPARATUS, INGOT CUTTING METHOD, INGOT CUTTING APPARATUS AND WAFER PRODUCING METHOD

BACKGROUND OF THE INVENTION

1. Field of the Invention

This invention relates to a cutting method and cutting apparatus by which a columnar (cylindrical) or prismatic (e.g. square pillar) base material, such as crystalline ingot, etc., is cut to obtain thin plates, such as wafers, etc., and to be more specific, relates to a cutting method and cutting apparatus by which thin plates, such as wafers, etc., are obtained by a photochemical reaction, etc. that makes use of light energy.

2. Description of the Related Art

Examples of processes, wherein a base material is cut into thin plates, include processes, wherein wafers, to be used for the manufacture of semiconductor devices, are cut from a columnar or prismatic crystalline ingot, comprising a crystal of Si or GaAs, etc.

Among such methods of cutting wafers from an ingot, there are methods of cutting an ingot physically by means of a diamond blade saw or wire saw, etc. However, with such machine cutting methods, a thick cutting margin is necessary and a large amount of the ingot is wasted.

Thus as a method of minimizing the waste of ingot as much as possible, Japanese Laid-Open No. Hei-9-141645 proposes a method, wherein a crystalline ingot is positioned within a chamber into which an etching gas is supplied and the etching gas is excited by illumination of light onto the crystalline ingot, thereby making a component of the etching gas react chemically with the component of the crystalline ingot and volatilizing the component of the crystalline ingot to cut the crystalline ingot and obtain wafers.

The part of the crystalline ingot that is cut is thus gradually removed and formed into a groove by volatilization (etching) from the surface to the interior of the ingot and then becomes completely cut at the final stage.

It is considered that by this cutting method, the cutting margin required for wafer cutting can be made thin in comparison to cases of mechanical cutting.

However, with the cutting method proposed in the abovementioned publication, the illumination of light onto a crystalline ingot is performed through an optical system, comprising a light source and a condenser lens that are disposed at the exterior of the chamber. Though by passage through the condenser lens, a light beam is illuminated in the form of a spot of somewhat restricted range onto the crystalline ingot, since the light beam converges in a cone-like shape up to the illumination spot, as etching progresses, the inner surface of the groove that is formed in the ingot becomes hit with light and the width (thickness) of the groove widens as etching progresses deeper. Thus as is indicated in the abovementioned publication, even if the spot diameter is set to approximately 100 $\mu$m, the groove width may greatly exceed several hundred $\mu$m. The waste of ingot therefore cannot be made adequately small even when the cutting method proposed in the abovementioned publication is used.

The application of the cutting method proposed in the abovementioned publication to a plurality of parts in the axial direction of the crystalline ingot in order to cut out a plurality of wafers simultaneously may also be considered.

However, if a light source is to be provided for each part that is cut, the arrangement of the cutting apparatus will become complicated and the cost may become high.

The efficiency of processing can be improved by cutting a plurality of wafers or other thin plates simultaneously from a base material, such as a crystalline ingot, etc.

However, if a plurality of wafers or other thin plates are simply cut out simultaneously, these thin plates that have been cut out may collide with each other, thereby leading to flawing of the thin plates.

Though this problem can be resolved by securely supporting the plurality of thin plates that are cut out so that the thin plates will not tilt or become overlapped, this is difficult to achieve in actuality.

SUMMARY OF THE INVENTION

The present invention provides a cutting method or cutting apparatus, by which at lease one thin plate is obtained by cutting a columnar or prismatic base material and wherein light from a light source is guided to the abovementioned base material via a sheet-like, bar-like, or fiber-like optical wave guide to cut the base material.

This invention also provides an ingot cutting method or cutting apparatus, wherein a crystalline ingot is positioned within an etching gas and the etching gas is excited by illumination of light from a light source onto the crystalline ingot, thereby making a component of the etching gas react chemically with a component of the crystalline ingot and volatilizing the component of the crystalline ingot to cut the crystalline ingot and obtain wafers, and wherein light from a light source is guided to the crystalline ingot via a sheet-like, bar-like, or fiber-like optical wave guide.

Here in order to improve the processing efficiency, a plurality of optical wave guides may be aligned in parallel in the axial direction of the crystalline ingot or other base material to guide light simultaneously to a plurality of parts of the base material and thereby process these plurality of parts simultaneously. Also in this case, light from a single light source may be made to enter the plurality of optical wave guides to minimize the necessary number of light sources.

Also with this invention's base material cutting method and cutting apparatus, a plurality of parts of a base material are removed simultaneously until these plurality of parts are put in a condition prior to being completely cut and then the plurality of parts in the condition prior to being completely cut are cut completely in a sequential manner starting from a single part located at the foremost end side of the base material.

Furthermore this invention provides an ingot cutting method or cutting apparatus, wherein a crystalline ingot is positioned within an etching gas and the etching gas is excited by illumination of light, guided from a light source and via a plurality of sheet-like, bar-like, or fiber-like optical wave guides, onto the crystalline ingot, thereby making a component of the etching gas react chemically with a component of the crystalline ingot and volatilizing the component of this crystalline ingot to cut the crystalline ingot and obtain wafers, and wherein light is first guided simultaneously to a plurality of parts of the crystalline ingot via a plurality of optical wave guides, which are disposed in parallel in the axial direction of the crystalline ingot, until these parts are put in a condition prior to being completely cut and then the plurality of parts are completely cut in a sequential manner by repeating a process of guiding light via the optical wave guide to only a single part, among the plurality of parts of the crystalline ingot in the condition prior to being completely cut, that is located at the foremost end side and cutting this single part.

This invention also provides a columnar base material cutting method or cutting apparatus, by which thin plates are obtained by cutting a columnar or prismatic base material, and wherein the base material is positioned in an inclined manner with respect to the horizontal direction so that a thin plate that has been cut will not tilt towards the remaining base material side and thin plates are thereupon obtained one by one by sequentially cutting the base material.

This invention also provides an ingot cutting method or ingot cutting apparatus, wherein a crystalline ingot is positioned within an etching gas and the etching gas is excited by illumination of light from a light source onto the crystalline ingot via a sheet-like or bar-like optical wave guide, thereby making a component of the etching gas react chemically with a component of the crystalline ingot and volatilizing the component of the crystalline ingot to cut the crystalline ingot and obtain wafers, and wherein the crystalline ingot is positioned in an inclined manner with respect to the horizontal direction so that a wafer that has been cut will not tilt towards the optical wave guide nor towards the remaining crystalline ingot side and wafers are thereupon obtained one by one by sequentially cutting the crystalline ingot.

A detailed configuration of the base material cutting method, base material cutting apparatus, ingot cutting method, ingot cutting apparatus and wafer producing method of the invention, the above and other objects and features of the invention will be apparent from the embodiments, described below.

DETAILED DESCRIPTION OF THE PREFERRED EMBODIMENTS

Hereinafter, preferred embodiments of the invention will be described in detail with reference to the drawings.

Figure 1:
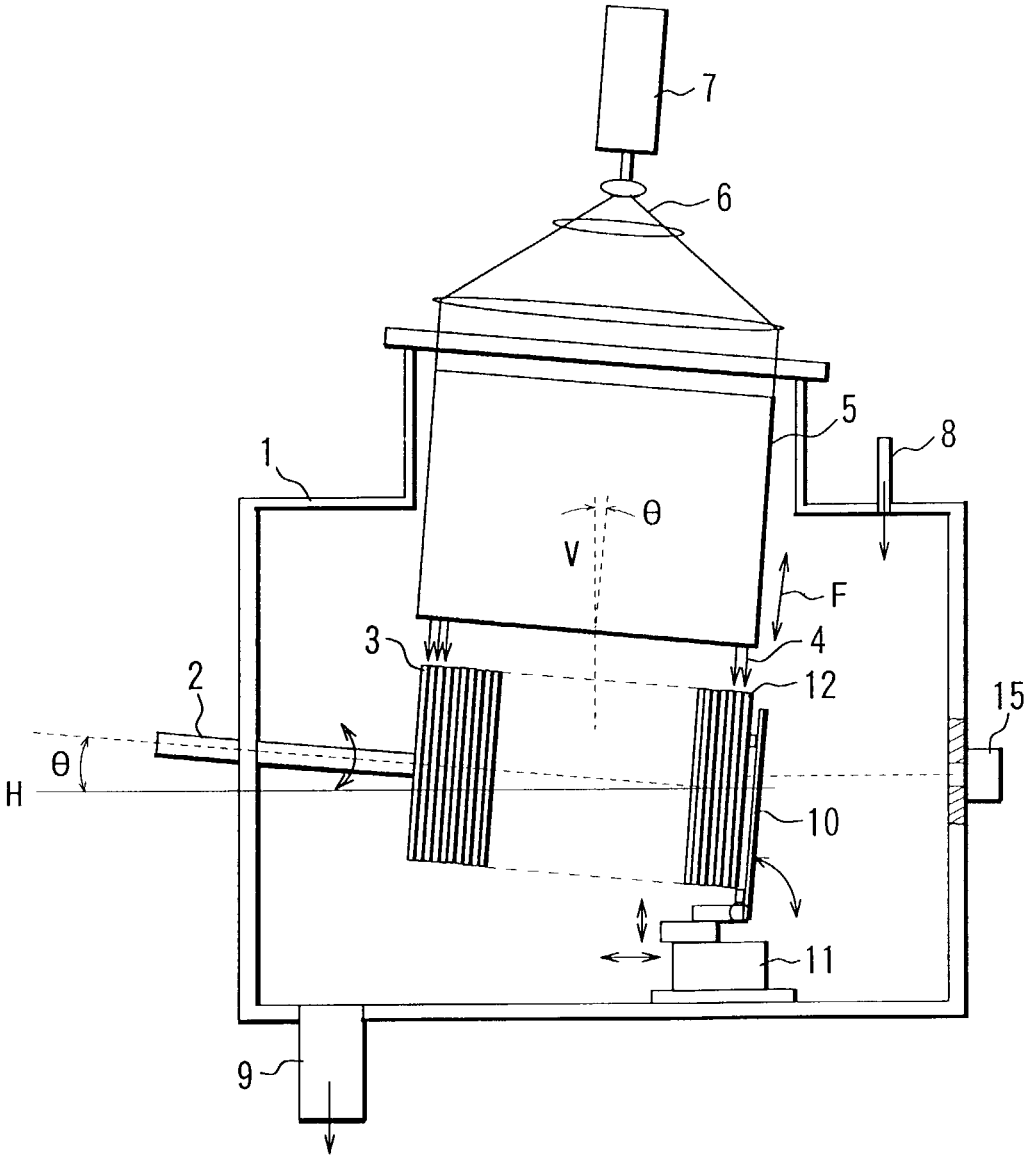
FIG. 1 is an overall arrangement diagram of an ingot cutting apparatus, which is an embodiment of this invention.

FIG. 1 shows the overall arrangement of an ingot cutting apparatus, which is an embodiment of this invention. In this FIG., 1 is a chamber and an etching gas supply piping 8, for supplying etching gas into the chamber 1, is connected to the upper part of the chamber 1. Also, an exhaust piping 9, for evacuating or drawing out etching gas from the interior of chamber 1, is connected to the lower part of the chamber 1. An unillustrated vacuum pump is connected to the exhaust piping 9.

As the etching gas, a gas comprising at least one component of $NF_3$, $CCl_2F_2$, $CF_4$, $C_2F_6$, $C_3F_8$, $CHF_3$, $CCl_4$, $SF_6$, $CCl_3F$, HCl and HF is used, and a solitary gas may be used or a mixed gas of two or more types of gases may be used.

Anti-corrosion treatment by at least one component of SiC, AlN, SiN, $Al_2O_3$, $AlF_3$, FRP treatment material, and CRP treatment material is applied to parts of the inner surface of the chamber 1 that may contact the etching gas.

At a lower space within chamber 1, a crystalline ingot 3 is positioned with its axis being inclined by just an angle θ of a few degrees with respect to a horizontal axis H. At the upper end in the direction of inclination of the crystalline ingot 3, a shaft 2 is mounted integrally and in a rotatable manner to the crystalline ingot 3 and an ingot holding member (not shown). An unillustrated driving motor is coupled via a speed reducer, etc., to this shaft 2, and the crystalline ingot 3 can be driven to rotate about its axis by the rotation of the driving motor.

Also, at the lower space within the chamber 1 is provided a robot 11, which is a handling mechanism that supports the wafers 12 that are cut out one by one from the lower end in the direction of inclination of the crystalline ingot 3 and also conveys and houses the wafers to and in an unillustrated load chuck chamber for taking out the wafers. As shown in the Figure, a hand part 10 of this robot 11 waits for a wafer to be cut out in a position that is substantially orthogonal to the axis of the crystalline ingot 3 and supports a wafer, which tends to tilt (lean) by its own weight towards the side opposite the remaining ingot 3 side, as it is.

The robot 11 is arranged to enable swinging and raising/lowering of the hand part 10 in the up/down direction. Also, the entirety of the robot 11 can move in the horizontal direction within the chamber 1.

$N_2$, Ar, or other inert gas is supplied into the load chuck chamber, and pressure control is performed so that in the condition where the partition wall of the load chuck chamber is opened, the pressure inside the load chuck chamber will be slightly more positive than the pressure inside the chamber 1.

Also, at an upper space within the chamber 1 is provided an optical guide unit 5, which guides a laser light 4, from a laser light source 7, onto the crystalline ingot 3. The optical guide unit 5 is disposed at an inclination of a few degrees θ (the same angle as the inclination angle of the crystalline ingot 3 with respect to the horizontal axis) with respect to a vertical axis V so that the direction in which the laser light is emitted will be perpendicular to the circumferential surface of the crystalline ingot 3.

Here, the optical guide unit 5 is arranged, as shall be described below, with a plurality of sheet-like optical wave guides aligned in parallel at a fixed interval and in the ingot axis direction. Also, an optical system 6, which can make the laser light from the laser light source 7 either enter the plurality of optical wave guides uniformly or enter a single specific optical wave guide, is disposed between the optical guide unit 5 and the laser light source 7.

Also, though not illustrated, an elevating mechanism is provided which drives the optical guide unit 5, along with the laser light source 7 and the optical system 6, upwards and downwards in the direction of the arrow F in the Figure (in the inclined direction) with these components being inclined a few degrees with respect to the vertical axis V.

Furthermore, on the outer surface of the chamber 1 is provided an optical detector 15 which detects the cutting depth of the crystalline ingot 3 from the exterior of the chamber and via a hole formed in the wall part of the chamber 1.

To be more specific, as the detector 15, a detector, which makes use of the transmitted light of a visible light, infrared light, etc. that has been introduced from the exterior of the chamber, a detector, which makes use of the scattered light of the laser light used for the etching of the crystalline ingot 3, or a detector, which makes use of the secondary light that is generated by the etching process, may be employed. For example, a television camera, which takes an image of the cut part of the crystalline ingot 3 by making use of such light as mentioned above, may be used. The position of such a type of television camera is not limited to the illustrated position but is preferably a position by which an image can be taken from the side face of the crystalline ingot 3.

With the present embodiment, an excimer laser of KrF, ArF, Ar, $F_2$, etc., is used for the laser light and in terms of the oscillation method, the laser may be a pulse type or a continuous type. i rays or deep UV light may also be used as light from a light source, such as a mercury lamp, ultrahigh pressure mercury lamp, xenon lamp, xenon mercury lamp, deuterium lamp, etc.

Figure 2:
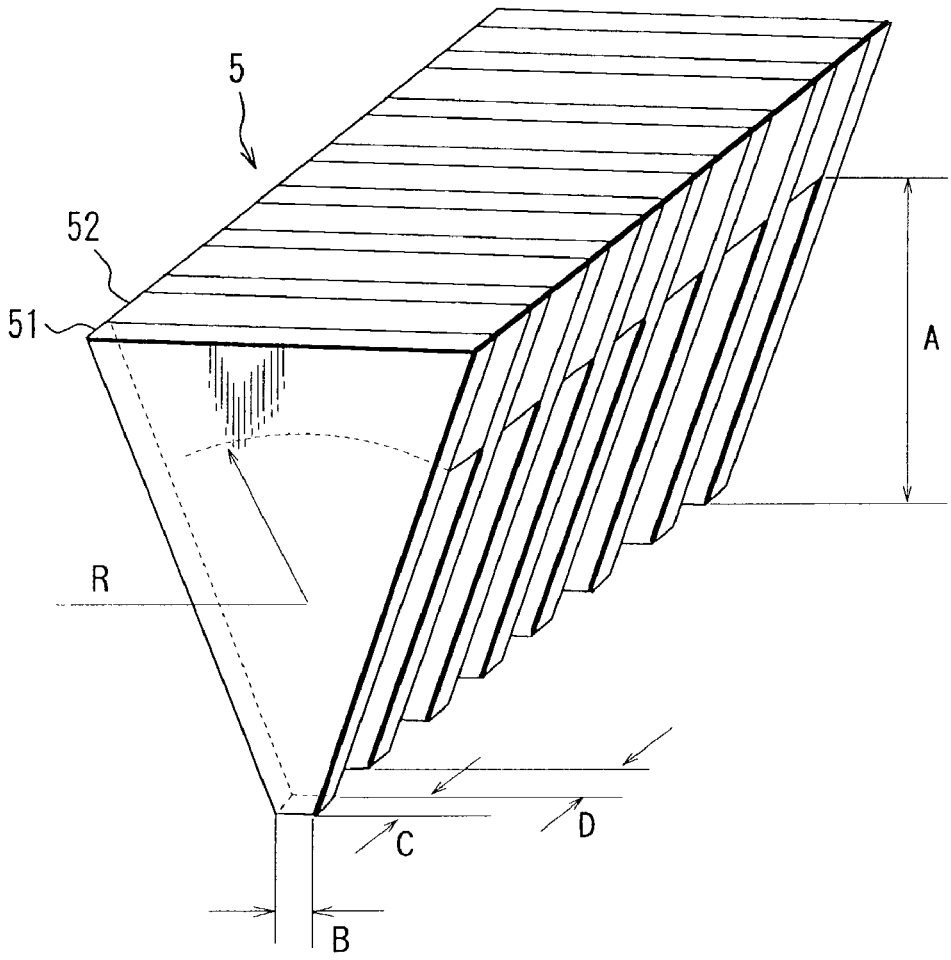
FIG. 2 is a perspective view of an optical guide unit used in the ingot cutting apparatus shown in FIG. 1.

The arrangement of the optical guide unit 5 shall now be described in detail using FIG. 2. With the present embodiment, a sheet-like optical wave guide of a substantially inverted trapezoidal shape is used as the optical wave guide 51. The long edge part at the upper end of the optical wave guide 51 is the entry surface on which laser light is made incident and the short edge part at the lower end is the exit surface from which laser light exits.

The optical guide unit 5 is arranged with a plurality of the optical wave guides 51 of the above-described shape aligned in parallel and with spacers 52 being sandwiched between these optical wave guides 51 to keep the interval between adjacent optical wave guides 51 fixed.

In terms of the material of the optical wave guide 51, fluorite or fluorine-doped quartz is used in the case where an $F_2$ laser is used, while quartz or the same material used when an $F_2$ laser is used is used in the case where an ArF or KrF laser is used. In the case where i rays are used, optical glass for i rays or the same material used when an ArF/KrF laser is used is used.

With respect to a diameter of 200 mm of the crystalline ingot 3, the length B of the exit surface of each optical wave guide 51 is set to a few mm, and the width (sheet thickness) C of the exit surface is set to a dimension (for example, 0.2 mm) that is slightly thinner than the cutting margin (for example, 0.4 mm) of the crystalline ingot 3. Each optical wave guide 51 is thus formed to be even thinner than the thin cutting margin (part to be cut).

The interval D between adjacent optical wave guides 51 is set to a dimension (for example, 1.0 mm) that is slightly greater than the wafer slice thickness (for example, 0.8 mm <to be more accurate, 775 μm>). The pitch of the optical wave guide 51 is 1.2 mm. Furthermore, the height A from the exit surface of each optical wave guide 51 to the lower end of the spacer 52 is set to a dimension that is greater to some degree than the radius of the crystalline ingot 3.

With the present embodiment, the lower end face of the spacer 52 is formed to a curved, arcuate shape that is convex in the upward direction and the radius R thereof is set to a dimension that is somewhat greater than the radius of the crystalline ingot 3. The ends in the width direction of the spacer 52 thus extend to near the middle part in the up/down direction of the optical wave guide 51, thereby enabling the mechanical strength of the optical wave guide 51 to be increased in comparison to the case where a spacer exists just at the upper part.

Figure 4:
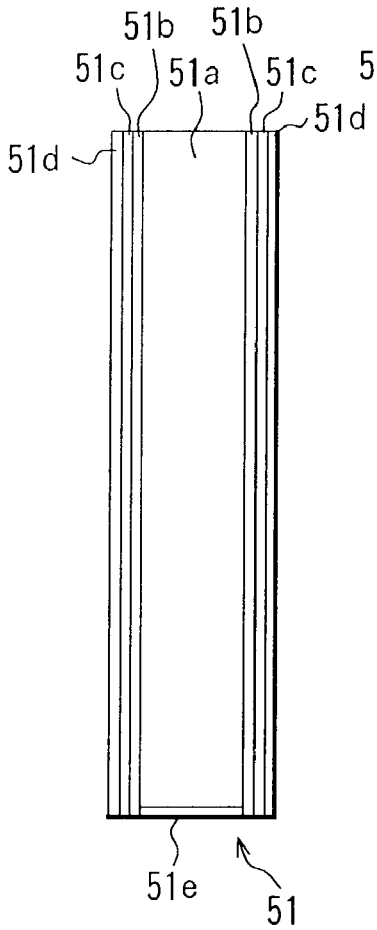
FIG. 4 are sectional views of optical wave guides and spacers that make up the optical guide unit shown in FIG. 2.
Figure 4:
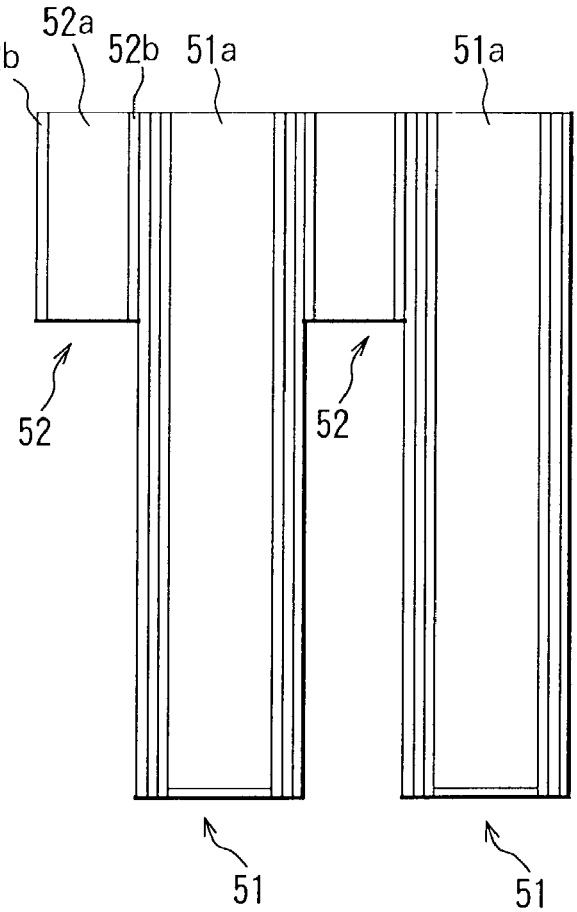

The arrangements of the optical wave guide 51 and the spacer 52 shall now be described further using FIG. 4(A). An optical wave guide 51 has a main body 51*a*, formed of quartz ($SiO_2$) and having the above-described shape, and a first coating film 51*b*, which is formed on surfaces except the entry surface and exit surface of the main body 51*a*.

A second coating film 51*c* is formed on the outer side of first coating film 51*b* and a third coating film 51*d* is formed on the outer side of the second coating film 51*c*.

Here, materials with the property of being high in corrosion resistance against the etching gas are selected for the first to third coating films 51*b* to 51*d*. Moreover, the materials of the first to third coating films 51*b* to 51*d* are selected so that the thermal expansion coefficient increases in the order from the main body 51*a* to the third coating film 51*d*.

To be more specific, at least one component is selected for the first to third coating films 51*b* to 51*d* from among Al, Ni, Ti, Cr, $Al_2O_3$, AlN, SiN, and SiC that satisfies the above conditions.

For example, $Al_2O_3$ may be selected as the first coating film 51*b*, Al may be selected as the second coating 51*c*, and either material among AlN, SiN, and SiC may be selected as the third coating 51*d*.

By sandwiching the first and second coating films 51*b* and 51*c* between the main body 51*a* and the third coating film 51*d*, the variation of thermal expansion coefficient from the main body 51*a* to the third coating film 51*d* is made gradual, and peeling of the third coating film due to the difference in thermal expansion coefficients being large, as in the case where the third coating film is formed directly on the main body, can be prevented.

Also, on the exit surface of the main body 51*a* is formed a coating film 51*e* that is transparent to the light from the light source and is high in corrosion resistant against the etching gas. As the material of the coating film 51*e*, for example, at least one material is selected from among $Al_2O_3$, $AlF_3$, $MgF_2$, $HfO_2$, $SrF_2$, NaF, LiF, $BaF_2$, and $CaF_2$. The same coating film may also be formed on the entry surface of the main body 51*a*.

The spacers 52 are disposed, as shown in FIG. 4(B), between the plurality of the optical wave guides 51 that are arranged as described above. A spacer 52 is arranged from a main body 52*a* that is formed, for example, of Al and a film 52*b* that is formed of $Al_2O_3$ on the outer side of the main body 52*a*. The film 52*b* is provided for improving the bonding with the third coating 51*d* of the optical wave guide 51.

In the case where the third coating film 51*d* is of $Al_2O_3$, the film 52*b* does not have to be provided.

Figure 5:
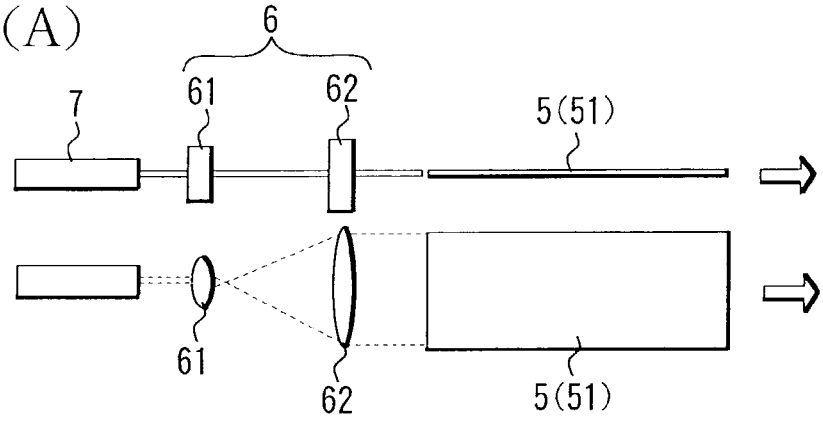
FIG. 5 are schematic arrangement diagrams of optical systems for guiding laser light to the optical guide unit shown in FIG. 2.
Figure 5:
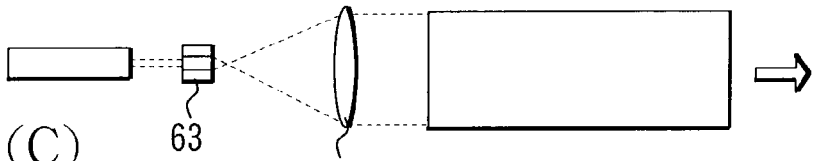
Figure 5:
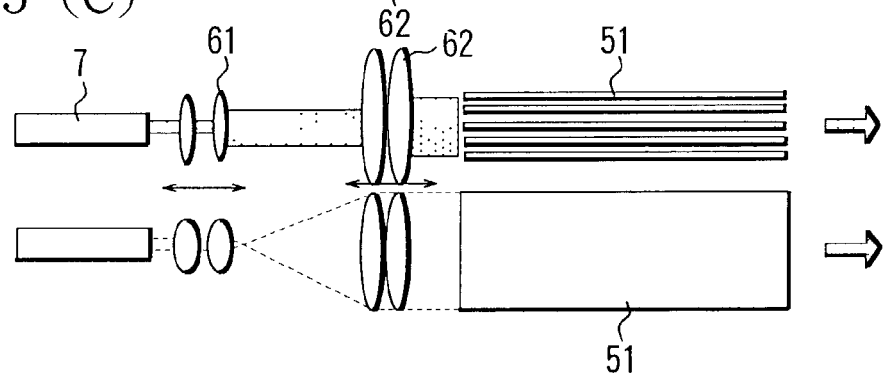
Figure 5:
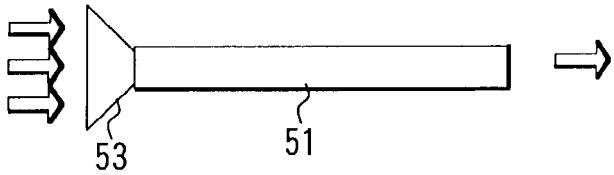
Figure 5:
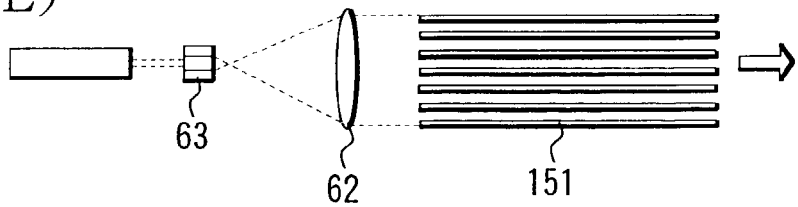

The arrangement of the optical system 6 which makes the laser light from the laser light source 7 be incident on each of the optical wave guides 51 of the optical guide unit 5 shall now be described using FIGS. 5(A) to 5(B).

First, FIG. 5(A) shows a basic arrangement for making the light beam from the laser light source 7 be incident on the sheet-like optical wave guides 51 efficiently (the upper drawing is a view from the direction of the side face of the optical wave guide 51 and the lower drawing is a view from the front face of the optical wave guide 51).

The optical system 6 is a unit with which the actions are determined by the shape of the light source and the two-dimensional shape of the entry surface of the optical wave guide 51, and in the case where the light source shape and the entry surface shape of the optical wave guide 51 are dissimilar, a cylindrical system is used.

In FIG. 5(A), the optical system 6 is arranged using cylindrical beam expanders 61 and 62. The divergent light beam from the laser light source 7 is formed into a sheet-like shape (made into parallel light) by these cylindrical beam expanders 61 and 62 and then made incident on the entry surface of the optical wave guide 51.

As shown in FIG. 5(B), the optical system 6 may be arranged with one of the elements being a fly-eye or cylindrical lens array 63 to make the distribution of illuminance on the entry surface of the optical wave guide 51 uniform.

When, in the case where laser light from the single laser light source 7 is to be made incident on a plurality of the sheet-like optical wave guides 51 as in the present embodiment, there is a need to control the amount of light that enters each individual optical wave guide 51. The optical system 6 may be provided with a zooming function to control the shape of the incident light beam on each optical wave guide 51.

For example, if the cylindrical beam expanders 61 and 62 are provided with a zooming function as shown in FIG. 5(C) and beam expanders 61 and 62 without refractive power are arranged by driving each individual cylindrical lens, the same beam shape as the beam shape immediately after emission from the light source 7 can be obtained immediately in front of the optical guide unit 5.

Also by variably controlling the relative positions of such an optical system 6 and optical guide unit 5 (plurality of the optical wave guides 51) in the direction orthogonal to the optical axis, the control of making the light beam from the laser light source 7 be incident on an arbitrary optical wave guide 51 in the optical guide unit 5 can be performed. It thus becomes possible for example, to make laser light of equivalent intensity exit from all optical wave guides 51 and make laser light exit from an arbitrary single or plurality of optical wave guides 51. Also in the case where laser light is to exit from one or a plurality of the optical wave guides 51, laser light that is stronger than that in the case where laser light of equivalent intensity is made to exit from all optical wave guides 51 can be made to exit.

In this case, a trapezoidal prism 53 which converges light may be disposed at the entrance surface side of the optical wave guide 51 as shown in FIG. 5(D) to prevent leakage of laser light from the gaps between the optical wave guides 51 and improve the utilization efficiency of light.

The same effects may also be obtained in the case where bar-like or fiber-like optical wave guides 151 are aligned in sheet-like manner as shown in FIG. 5(E).

Though not illustrated, as a method that differs from that shown in FIG. 5(C), a light blocking member, which functions as a shutter, may be disposed in front of the entrance surface of each of the plurality of the optical wave guides 51 to make laser light of equal intensity exit from all optical wave guides 51 by setting all of the light blocking members to the open condition and make laser light exit from just a single, arbitrary optical wave guide 51 by setting just the light blocking member, disposed in front of the entry surface of the single optical wave guide 51, to the open condition and by setting other light blocking members to the shut condition.

Figure 6:
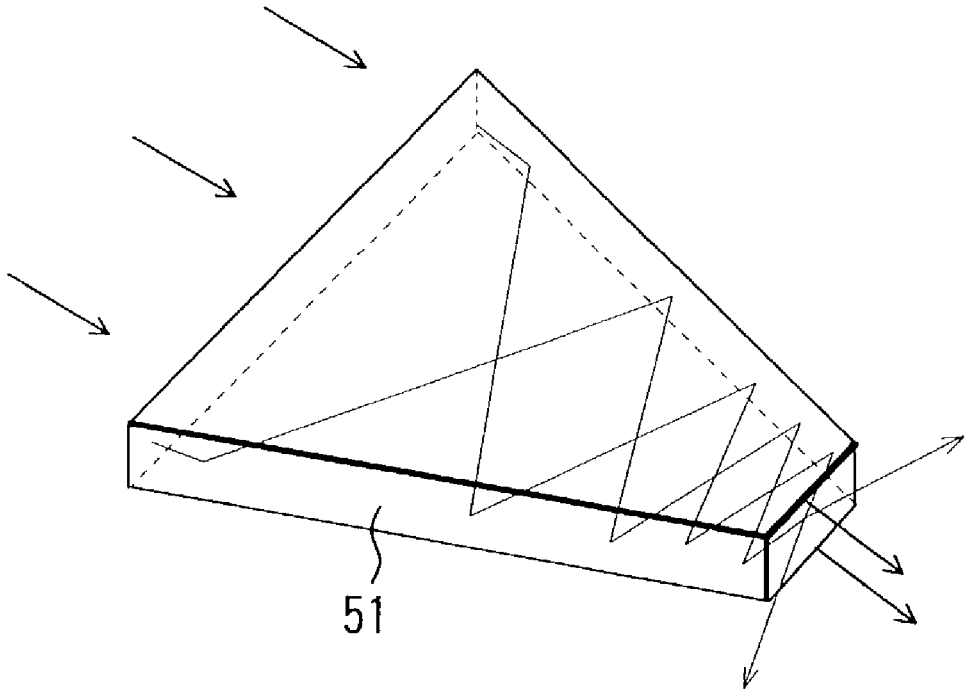
FIG. 6 is a schematic view, showing the conditions of the light beam that passes through the optical wave guide shown in FIG. 4.

As shown in FIG. 6, the light beam that has entered into an optical wave guide 51 is, in regard to the thickness direction of the optical wave guide 51, emitted from the exit surface as parallel light and, in regard to the width direction, is totally reflected by the inner inclining surfaces of the optical wave guide 51 (the main body 51*a*) and thereby guided to the exit surface side and made to exit in a diverging manner from the exit surface.

Thus, the part of the crystalline ingot 3 that is to be cut can thereby be brought close to the exit surface of the optical wave guide 51 and a light beam, which is small (thin) in regard to the ingot axis direction and is spread to some degree in the ingot circumference direction, is thus illuminated onto the part of the crystalline ingot 3 that is to be cut. The light beam is thus illuminated in the form of a short line or a narrow spot onto the part to be cut of the crystalline ingot 3 that has been brought close to the exit surface. Laser light is not emitted from the surfaces except the exit surface of the optical wave guide 51.

Figure 7:
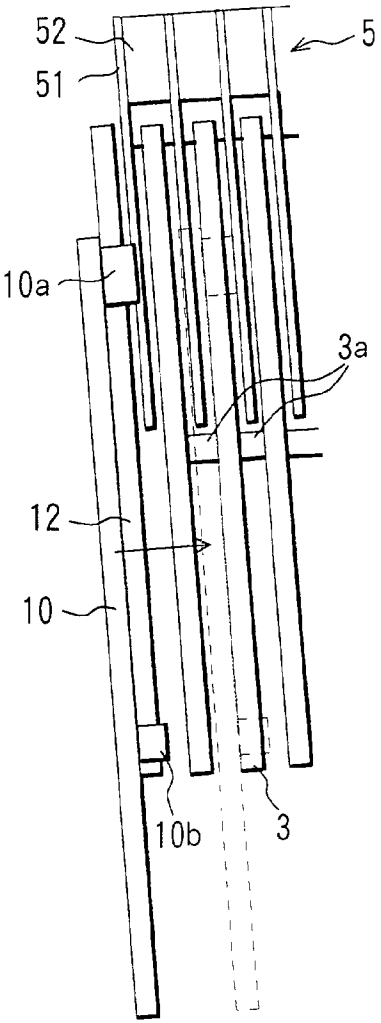
FIG. 7 are diagrams, showing the relationship between a hand part of a robot and the optical guide unit in the ingot cutting apparatus shown in FIG. 1.
Figure 7:
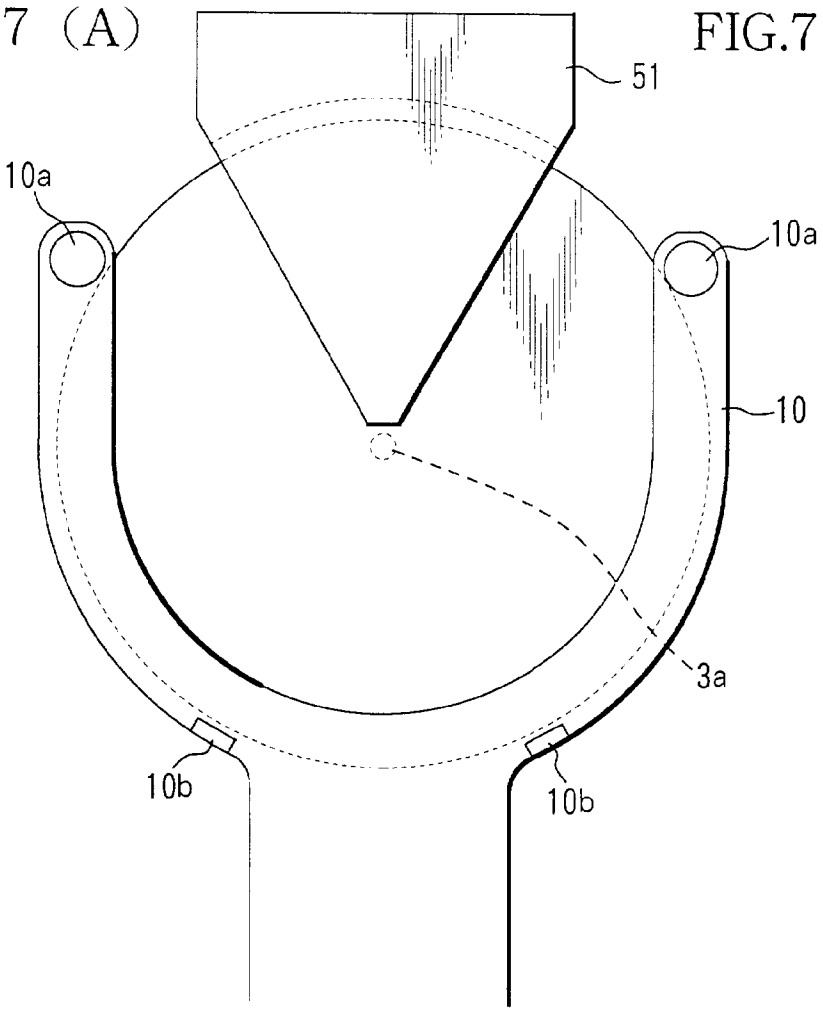

The relationship between the shape of the above-described optical guide unit 5 (the optical wave guide 51) and the shape of the hand part 10 of the robot 11 shall now be described using FIGS. 7(A) and 7(B).

By the optical wave guide 51 being formed to a substantially inverted trapezoidal shape, a space, which enables the hand part 10 of the robot 11 to be positioned without interfering with the optical guide unit 5, is formed from the sides to the lower edge of the optical guide unit 5 in the condition where it has been lowered to the lower end position as shown in FIG. 7(A).

Meanwhile, the hand part 10 is formed to a substantially U-like shape in accordance to the above-described space. The hand part 10 can thus be moved in the ingot axis direction without interfering with the optical guide unit 5 even when the cut position of a wafer 12 moves in the ingot axis direction as indicated by the dotted lines in FIG. 7(B).

Protrusions 10*a* and 10*b*, which contact and support the outer circumferential surface of a wafer 12 that is cut out from the crystalline ingot 3, are formed on the ingot side surface at the left and right upper end parts and lower end parts of the hand part 10. The hand part 10 has a height that extends from the lower end side of the wafer 12 (the crystalline ingot 3), beyond the wafer center, and to an upper intermediate position so that even when it swings to a horizontal position or the like, the wafer 12 will be supported in a stable manner.

Also, while contacting the outer circumferential surface of the wafer 12 with the abovementioned protrusions 10*a* and 10*b*, the hand part 10 also contacts just a part near the circumferential edge of the rear surface of the wafer 12 with the entire, U-shaped surface at the ingot side.

There is thus no danger of the wafer surface, on which semiconductor elements are formed, becoming flawed by the supporting by the hand part 10.

Moreover, since the crystalline ingot 3 takes on an inclined position with respect to the horizontal axis as has been mentioned above and the hand part 10 waits for a wafer 12 to be cut out at the lower end side in the direction of inclination of the crystalline ingot 3, the wafer 12 that is cut out from the crystalline ingot 3 becomes supported by the hand part 10 as it is by the action of its own weight and will never tilt towards the remaining ingot 3 side.

A wafer 12 is thus prevented from hitting an optical wave guide 51 that opposes its surface and thereby causing the flawing of the wafer surface on which semiconductor elements, etc., are formed and breakage of the optical wave guide 51.

Figure 8:
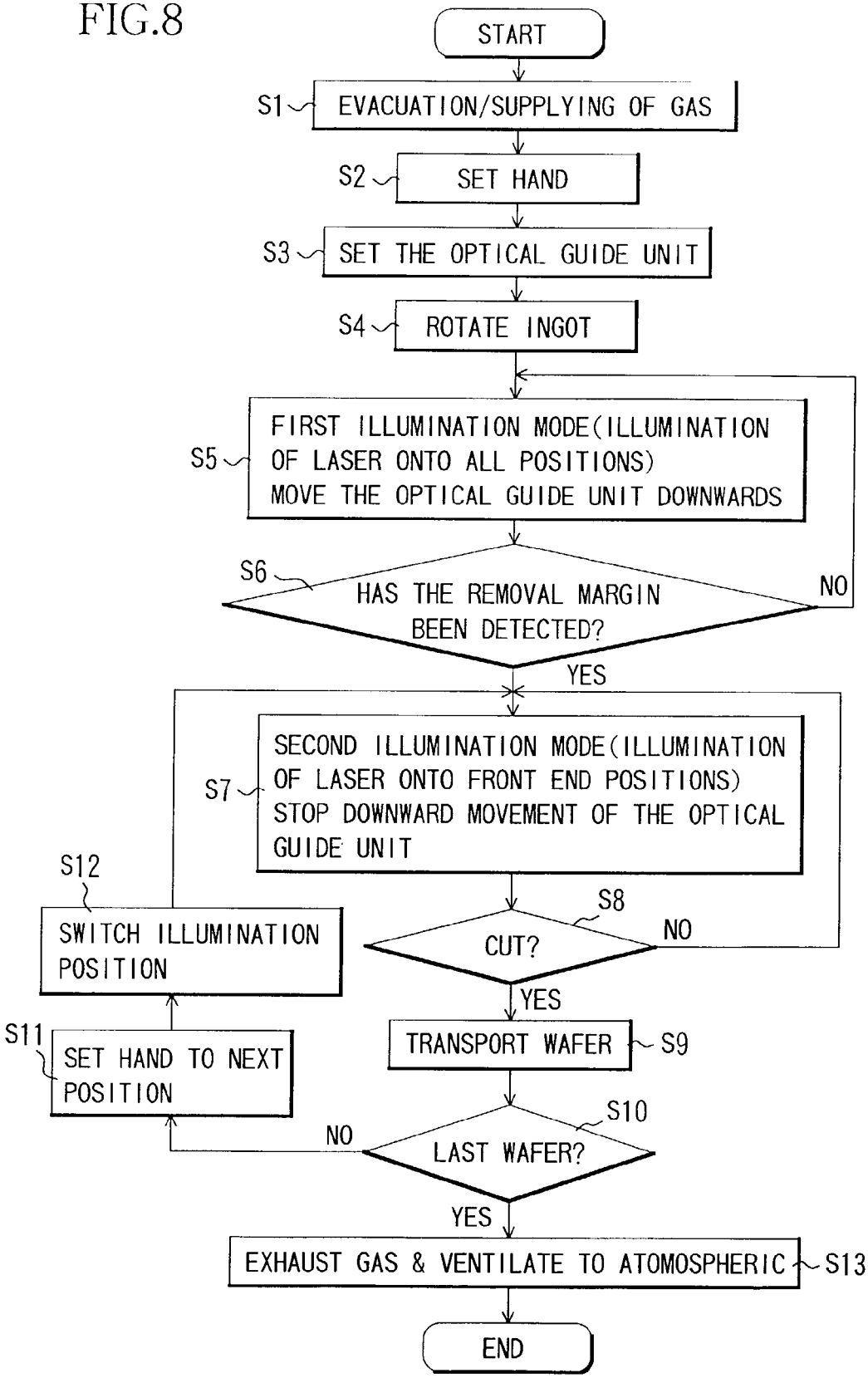
FIG. 8 is a flowchart, showing the control operation of the ingot cutting apparatus shown in FIG. 1.

The operation control of the present embodiment's ingot cutting apparatus shall now be described using the flowchart of FIG. 8. The operation control of this apparatus is carried out by an unillustrated control unit.

First, when the operation of this apparatus starts, the vacuum pump is driven and the interior of the chamber 1 is evacuated via exhaust piping 9 in Step (abbreviated as "S" in the Figure) 1. The interior of the chamber 1 is thereby evacuated to approximately $10^{-3}$ Torr. Thereafter, etching gas is supplied into the chamber 1 via the etching gas supply piping 8 and the supply rate is controlled to realize a predetermined pressure. The etching gas may be heated to a high temperature of 300 to 600 degrees at this time.

Next in Step 2, the robot 11 is made to operate and the hand part 10 is moved to the initial position (the position indicated by the solid line in FIG. 7(B)) near the lower end in the direction of inclination of the crystalline ingot 3.

Then in Step 3, the elevating mechanism is made to operate and the optical guide unit 5 is thereby brought close to a position at which the exit surfaces of the respective optical wave guides 51 will be at a predetermined distance from the circumferential surface of the crystalline ingot 3. The crystalline ingot 3 is set inside the chamber 1 in an accurately positioned condition where the priorly determined parts that are to be cut oppose the exit surfaces of the respective optical wave guides 51.

And in Step 4, the driving motor is made to operate to rotate the crystalline ingot 3 about its axis. The rotation speed is selected suitably in accordance to the rate by which a component of the etching gas and the crystalline ingot component undergo a chemical reaction due to laser light illumination from the optical guide unit 5 and the crystalline ingot 3 is removed by etching.

Figure 9:
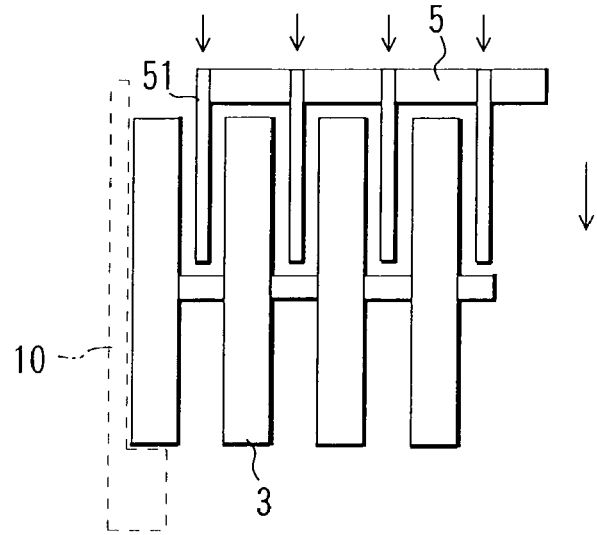
FIG. 9 are explanatory diagrams of the process of crystalline ingot cutting by the abovementioned ingot cutting apparatus shown in FIG. 1.
Figure 9:
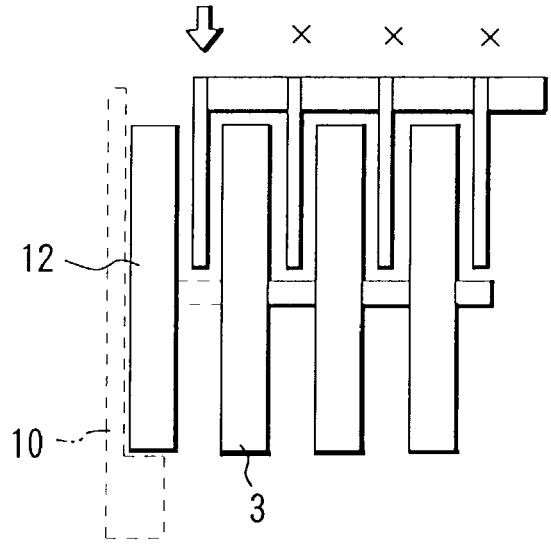
Figure 9:
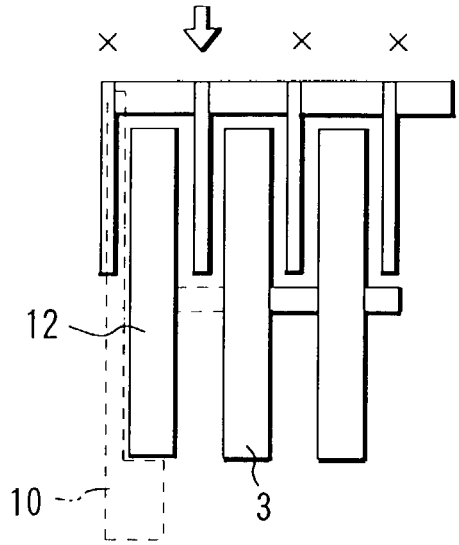

When the preparation for processing is thus completed, laser light is emitted from laser light source 7 in Step 5. The laser light is guided to all optical wave guides 51 of the optical guide unit 7 via the above-described optical system 6, and then, as shown in FIG. 9(A), is illuminated on the respective parts to be cut of the crystalline ingot 3 from the exit surfaces of the respective optical wave guides 51 (hereinafter, this illumination operation shall be referred to as the "first illumination mode", and in FIG. 9(A), the optical wave guide 51 to which laser light is guided is indicated by the ↓ mark). Etching removal of all parts to be cut is thus started.

Here, the laser light intensity is preferably controlled so that the temperature of the parts to be cut will be in the range of 300 degrees to 600 degrees.

Figure 3:
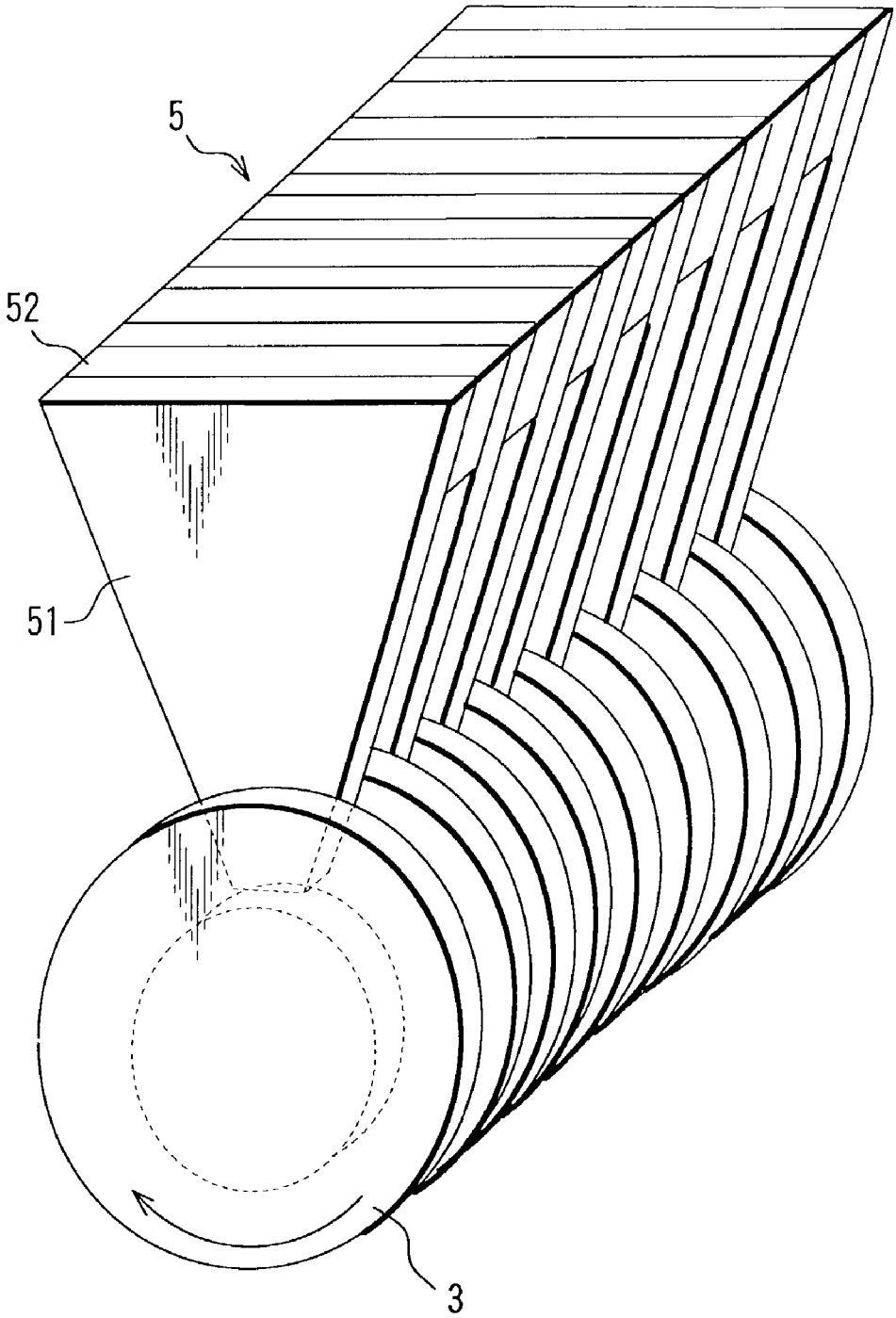
FIG. 3 is a conceptual view (perspective view), showing the condition of cutting of a crystalline ingot by the abovementioned ingot cutting apparatus shown in FIG. 1.

Also at this time, the operation of the elevating mechanism is started and the optical guide unit 5 is moved downwards at a predetermined speed by which, in accordance to the rate at which the crystalline ingot 3 is removed by etching, the distances between the exit surfaces of the respective optical wave guides 51 and the etched parts of the parts to be cut will be kept fixed at the abovementioned predetermined distance. A groove (slit) is thus formed at each part to be cut and each optical wave guide 51 enters into each groove as the etching removal of each part to be cut progresses as shown in FIG. 3.

In the process in which each optical wave guide 51 enters into each groove, since laser light is not emitted from the surfaces except the exit surface of each optical wave guide 51 as has been mentioned above and since the laser light that is illuminated from the exit surface onto the etched part of the part to be cut does not spread beyond the thickness of the optical wave guide 51 in regard to the ingot axis direction (though the light may spread depending on the arrangement of the optical system, the spread will be small), the etching process will progress with the groove being kept in a narrow, slit-like form. The cutting margin can thus be made narrow in comparison to the prior-art type in which laser light is simply converged in a conical form from the exterior of the chamber by use of a condenser lens, etc. The waste of the crystalline ingot can thus be reduced and the number of wafers cut out from a crystalline ingot of the same size can be increased.

Then when in Step 6, the remainder (removal margin) 3*a* of each part that is to be cut has been reduced to approximately 3 to 5 mm in diameter as shown in FIG. 7(B) and this is detected by the detector 15, Step 7 is entered.

In Step 7, the position of the optical system 6 with respect to the optical guide unit 5 is changed as shown in FIG. 9(B) so that laser light is guided to only a single optical wave guide 51 of the optical guide unit 5 (this illumination operation shall be referred to the "second illumination mode", and in FIG. 9(B), the optical wave guides 51 to which laser light is not guided are indicated by the x mark). Since this is the cutting process for the first wafer, the position of the optical system 6 is determined so as to guide laser light to only the optical wave guide 51 of the optical guide unit 5 that is located at the lowermost end (tip) side in the ingot axis direction. The laser light is then illuminated.

Thus among the plurality of the removal margins 3*a* formed in the crystalline ingot 3, just the removal margin 3*a* at the lowermost end side in the ingot axis direction becomes removed by etching and a single wafer 12 is cut out in the final step.

In this second illumination mode, the intensity of the laser light guided to the optical wave guide 51 is preferably made stronger (as indicated by the thick, hollow arrow in FIG. 9(B)) than the intensity of the laser light guided to each optical wave guide 51 in the first illumination mode. The cutting out of wafer 21 can thereby be performed efficiently (also, rapidly) by making adequate use of the output performance of the single laser light source 7. However, there will be no problems even if the intensity is equivalent to the intensity of the laser light guided to each optical wave guide 51 in the first illumination mode.

When in Step 8, it has been detected by the detector 15 that the cutting out of a single wafer 12 has been completed, Step 9 is entered. In Step 9, the robot 11 is actuated and made to convey the cut-out wafer 12, supported in the hand part 10, to the load lock chamber.

Then in Step 10, whether or not the wafer 12 that has been cut out is the last wafer is judged. If the wafer is not the last wafer, Step 11 is entered. The judgment of whether or not a wafer is the last wafer can be made by setting the number of wafers to be cut out at a counter in advance, decrementing the counter value by 1 each time a wafer is cut out, and judging that a wafer is the last wafer when the counter value becomes 0.

In Step 11, the robot 11 is actuated for the cutting out of the next wafer and is made to move the hand part 10 to the position for supporting the next wafer cutting part of the remaining crystalline ingot 3 as shown in FIG. 9(C).

Then in Step 12, the position of the optical system 6 with respect to the optical guide unit 5 is changed as shown in FIG. 9(C) so that laser light is guided to only the second optical wave guide 51 of the optical guide unit 5 from the lower end side in the ingot axis direction (second illumination mode). Thus among the removal margins 3*a* of the crystalline ingot 3 after the cutting out of the first wafer 12, just the removal margin 3*a* at the lowermost end side in the ingot axis direction becomes removed by etching and the second wafer 12 is cut out.

By thus repeating Step 7 through Step 12, wafers 12 are cut out and conveyed to the load lock chamber one at a time. Then when in Step 10, it is judged that the cutting of the last wafer has been completed, Step 13 is entered to evacuate the etching gas from inside the chamber 1 and end all operations.

Figure 10:
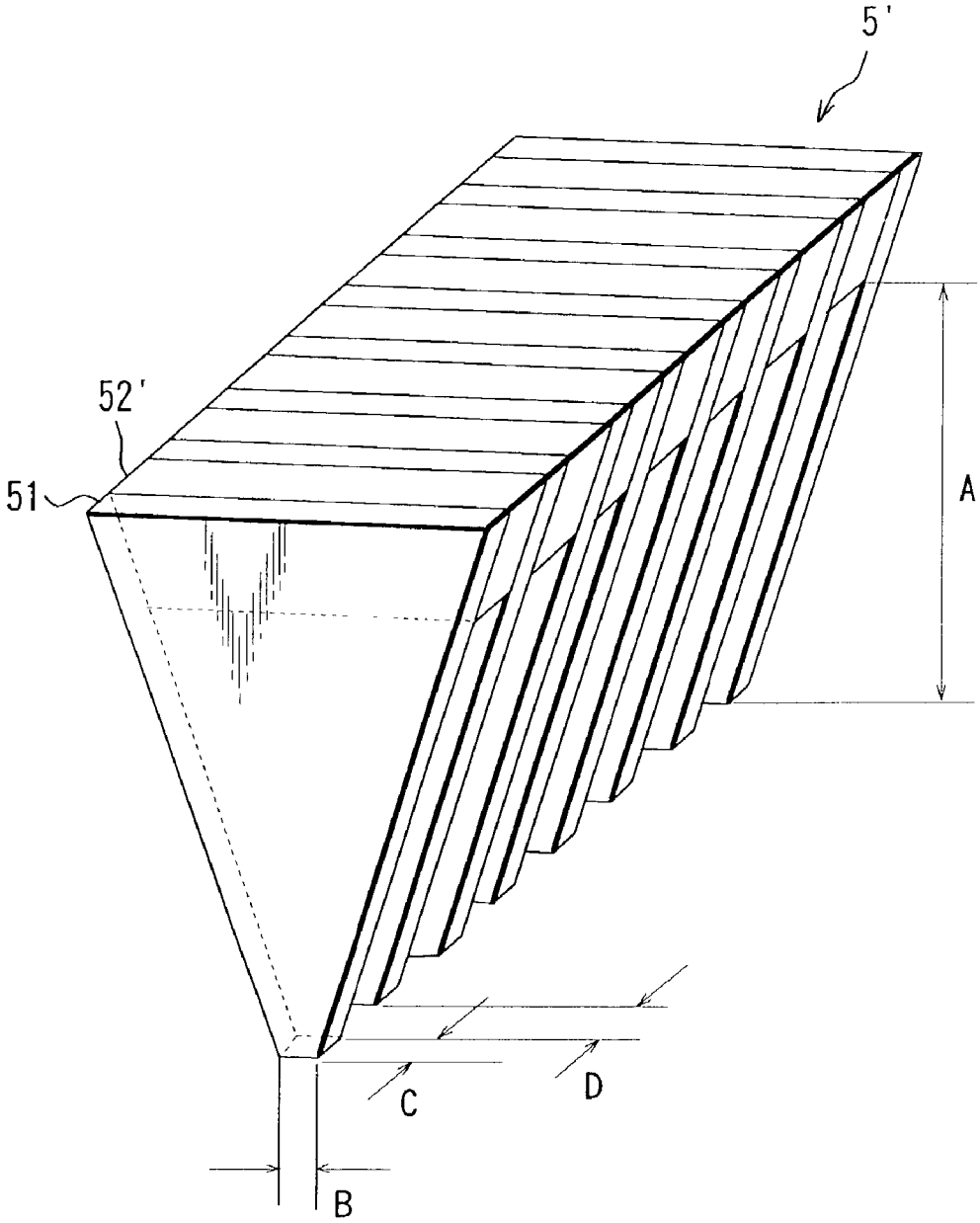
FIG. 10 is a perspective view of an optical guide unit used in an ingot cutting apparatus, which is another embodiment of this invention.

In place of the optical guide unit 5 used in the above-described embodiment, an optical guide unit 5', which, as shown in FIG. 10, has a simple, planar shape as the shape of the lower end face of a spacer 52', may be used.

Figure 11:
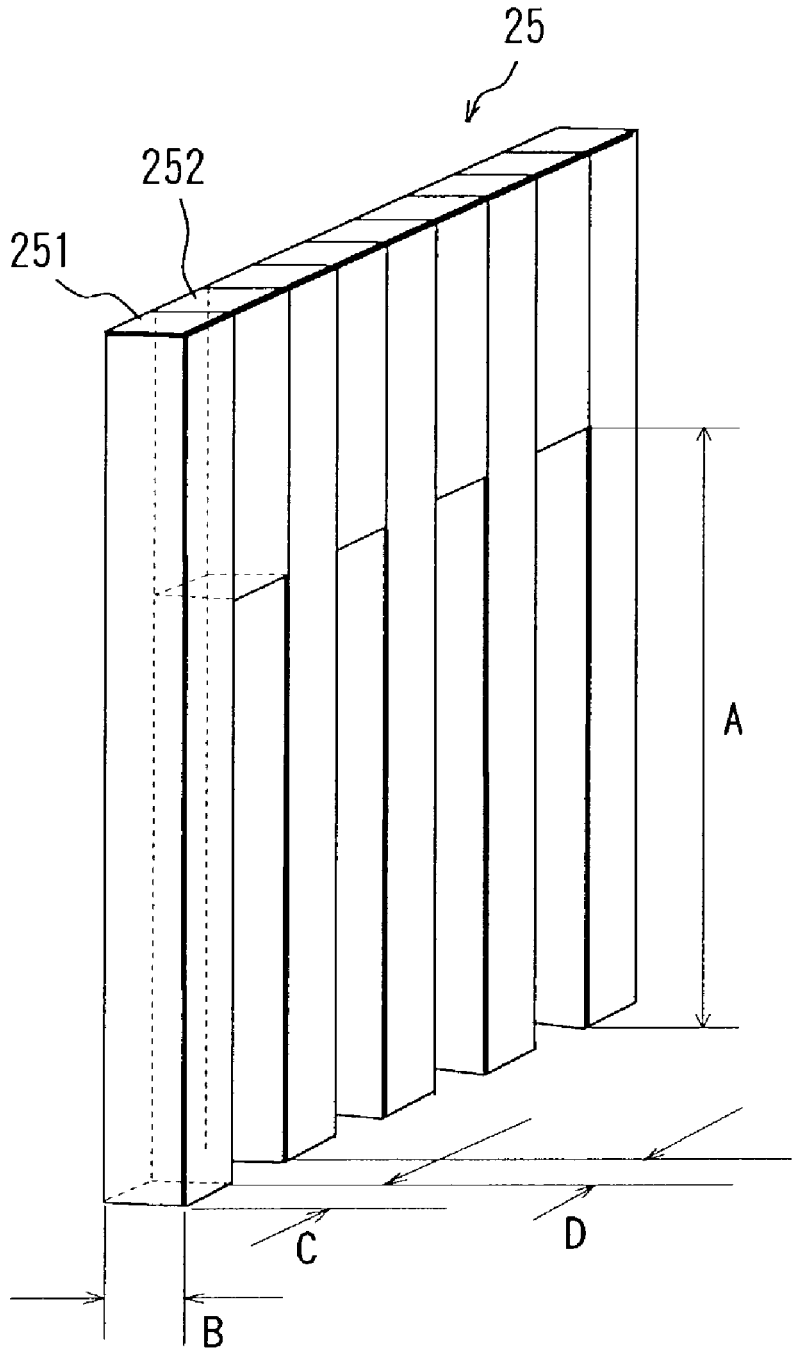
FIG. 11 is a perspective view of an optical guide unit used in an ingot cutting apparatus, which is yet another embodiment of this invention.

Though the case of using an optical guide unit that uses sheet-like optical wave guides was described for the embodiments above, an optical guide unit 25, which comprises optical guide units 251 of square bar shape (for example, 0.2 mm square) and corresponding spacers 252 of square bar shape as shown in FIG. 11, may be used instead.

As with the optical guide unit of the first embodiment, coating films are formed on the respective surfaces of the main bodies of the optical wave guides, comprising quartz, in this case as well.

By using such bar-like optical wave guide 251, the laser light that is illuminated onto the part to be cut of the crystalline ingot 3 can be narrowed in the range of illumination in the ingot circumference direction (the light beam can be illuminated as a spot) in comparison to the case where sheet-like optical wave guide is used. The etching process can thus be performed more efficiently.

Even thinner fiber-shaped optical wave guides may also be used in place of the optical wave guides 251 of square bar shape.

Figure 12:
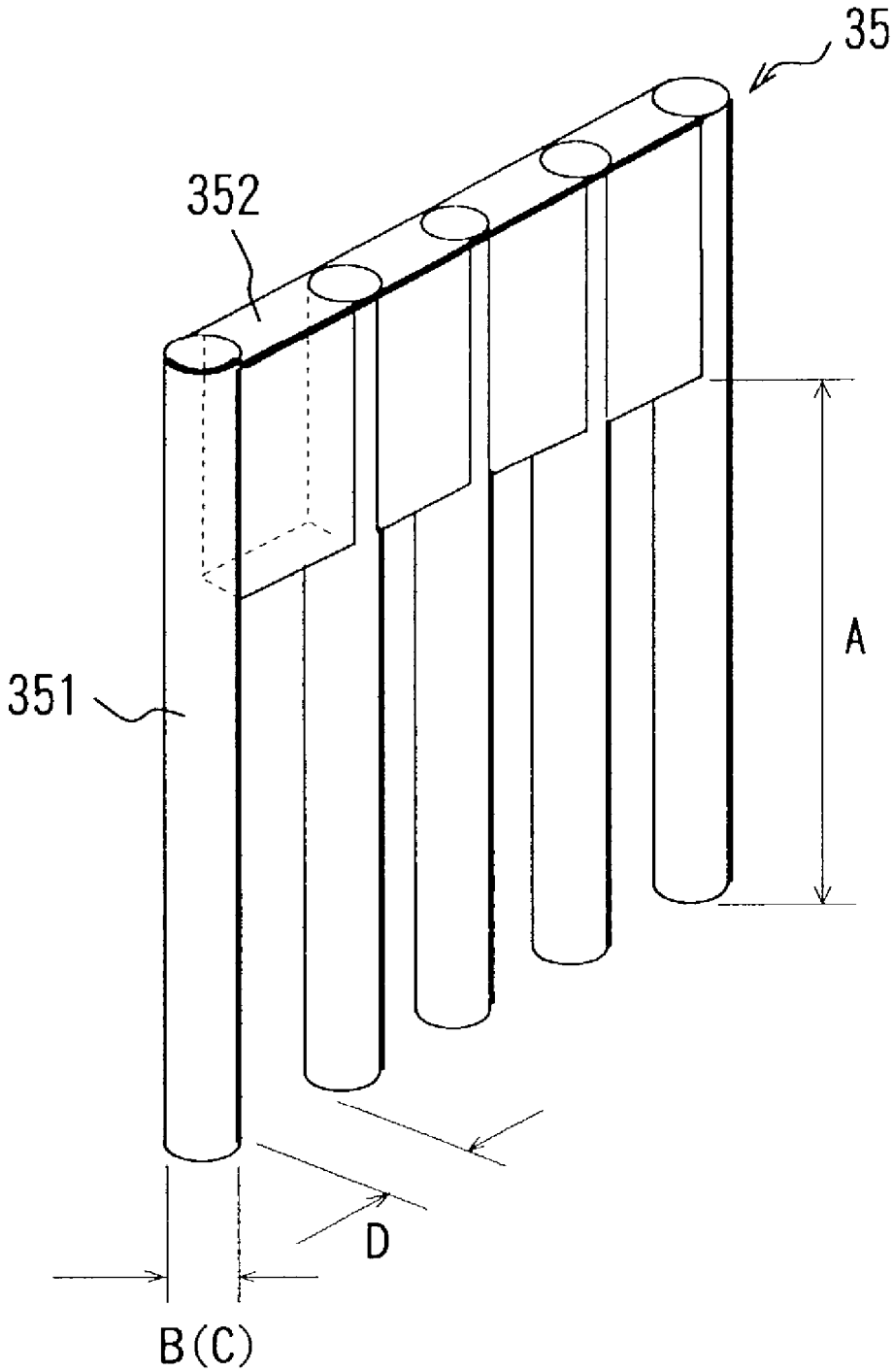
FIG. 12 is a perspective view of an optical guide unit used in an ingot cutting apparatus, which is yet another embodiment of this invention.

Also in place of the optical guide unit 25 shown in FIG. 11, an optical guide unit 35, which comprises optical wave guide 351 of round bar shape (for example, 0.2 mm in diameter) and corresponding spacers 352 as shown in FIG. 12, may be used instead.

In cases where the optical guide units shown in the abovementioned FIGS. 10 through 12 are used, the control operations of the cutting apparatus are the same as those of the first embodiment.

Figure 13:
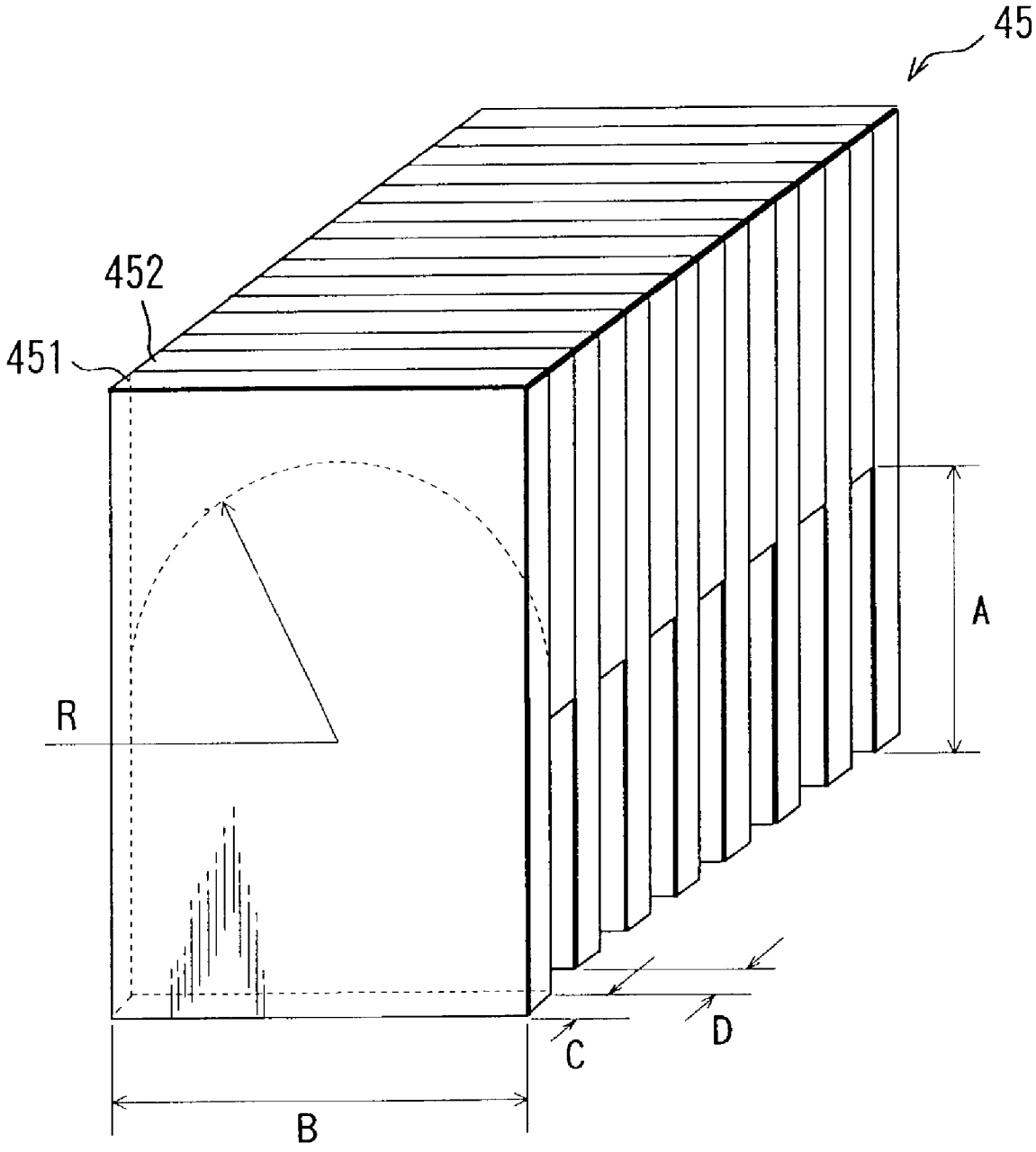
FIG. 13 is a perspective view of an optical guide unit used in an ingot cutting apparatus, which is yet another embodiment of this invention.

Though cases where the laser light, which is illuminated onto the part to be cut of the crystalline ingot 3, is converged to a spot-like shape and the etching process is performed while rotating the crystalline ingot 3 were described with the respective embodiments above, optical wave guides 451 may be formed as rectangular sheets as shown in FIG. 13. In the case where this optical guide unit 45 is used, etching may be performed while keeping still (that is, without rotating) the crystalline ingot 3.

With respect to a diameter of 200 mm of the crystalline ingot 3, the length B of the exit surface of each optical wave guide 451 is set to be slightly greater than the diameter of the crystalline ingot 3 and the width (sheet thickness) C of the exit surface is set to a dimension (for example, 0.2 mm) that is slightly thinner than the cutting margin (for example, 0.4 mm) of the crystalline ingot 3. Also, the interval D between adjacent optical wave guides 451 is set to a dimension (for example, 1.0 mm) that is slightly greater than the wafer slice thickness (for example, 0.8 mm <to be more accurate, 775 μm>). The pitch of the optical wave guide 451 is 1.2 mm. Furthermore, the height A from the exit surface of each optical wave guide 451 to the lower end of the spacer 52 is set to a dimension that is greater to some degree than the radius of the crystalline ingot 3.

With the present embodiment, the lower end face of the spacer 452 is formed to a curved, arcuate shape that is convex in the upward direction and the radius R thereof is set to a dimension that is somewhat greater than the radius of the crystalline ingot 3. The ends in the width direction of the spacer 452 thus extend to near the middle part in the up/down direction of the optical wave guide 451, thereby enabling the mechanical strength of the optical wave guide 451 to be increased in comparison to the case where a spacer exists just at the upper part.

As with the optical guide unit 5 of the embodiment shown in the FIG. 4(A), coating films are formed on the respective surfaces of the main bodies of the optical wave guides 451, comprising quartz, in this embodiment as well. Also, the spacers 452 of the same arrangement as those of the first embodiment are disposed between the optical wave guides 451.

Figure 14:
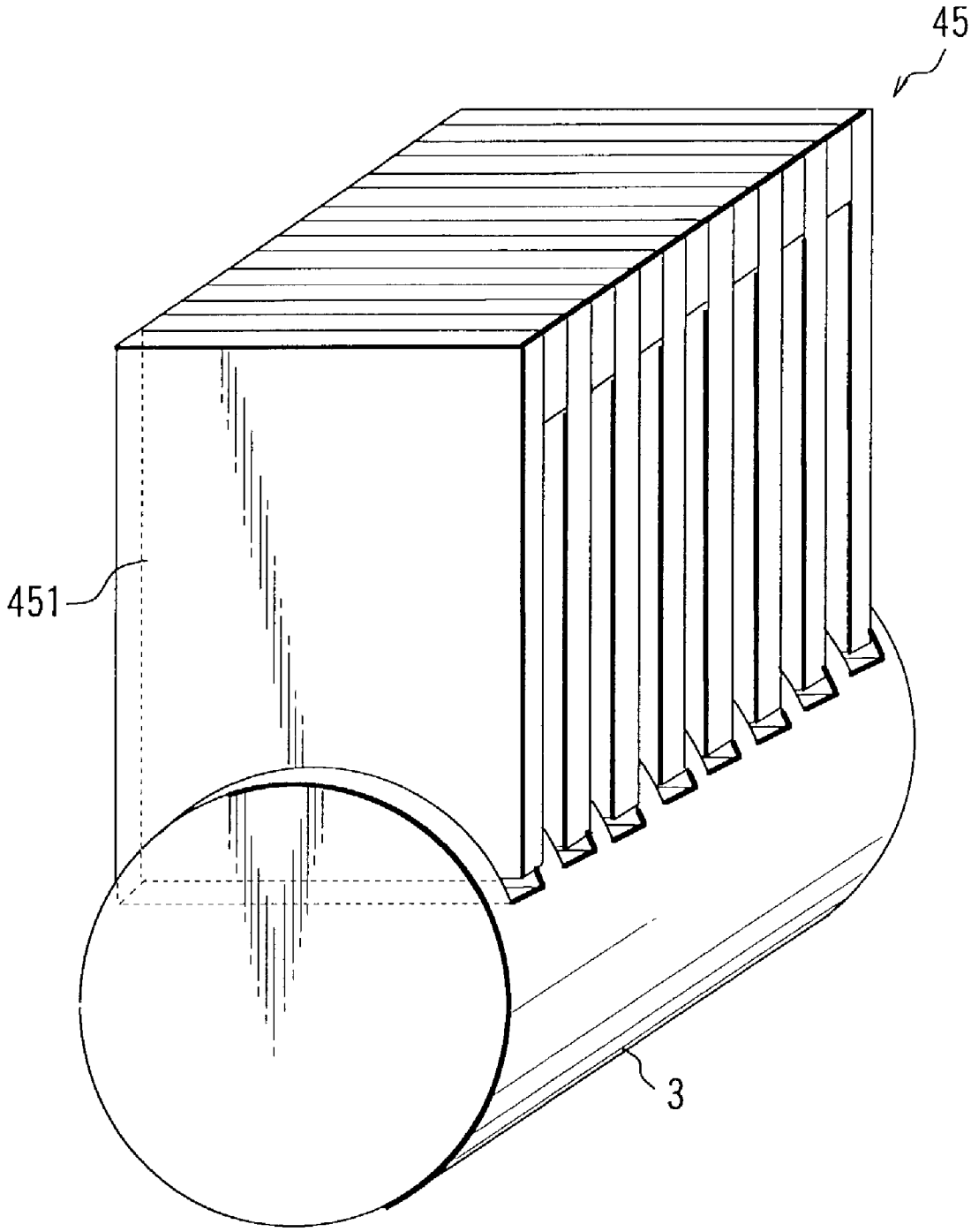
FIG. 14 is a conceptual view (perspective view), showing the condition of cutting of a crystalline ingot by the ingot cutting apparatus shown in FIG. 13.
Figure 15:
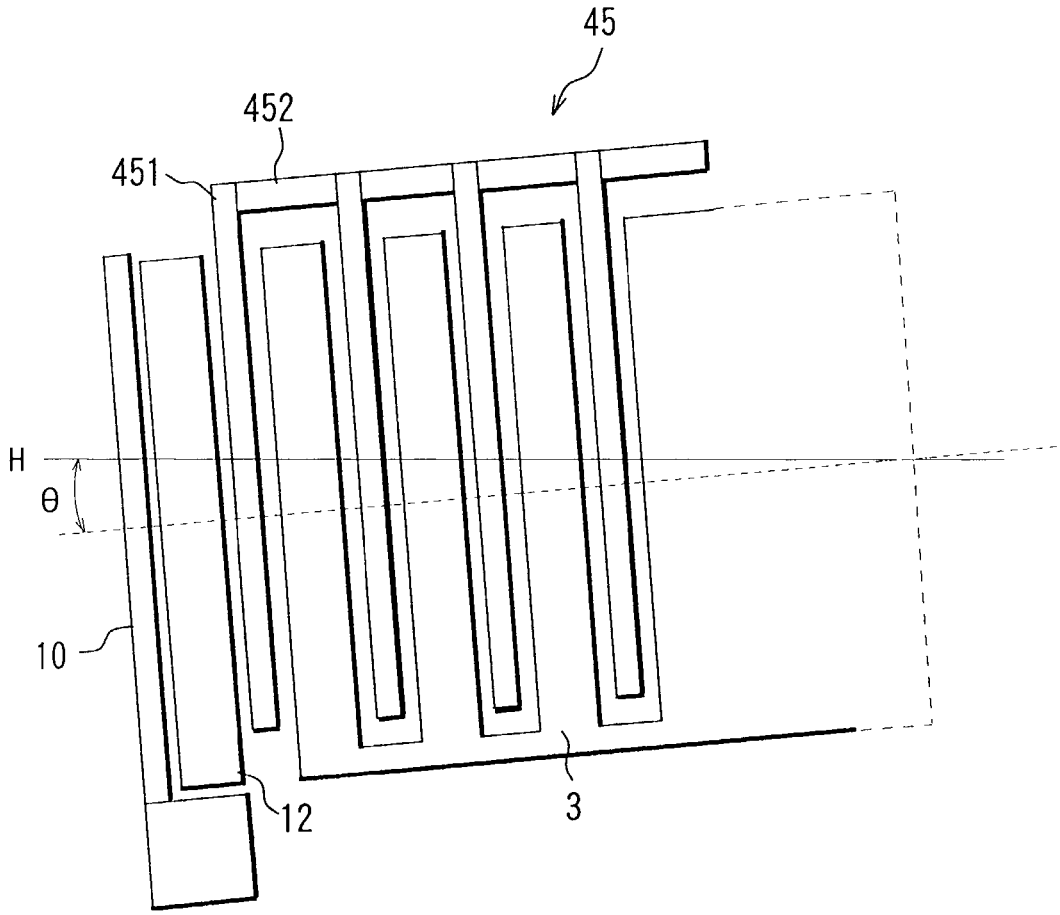
FIG. 15 is a conceptual view (side view), showing the condition of cutting of a crystalline ingot by the ingot cutting apparatus shown in FIG. 13.

With the present embodiment, the light beam that exits from an optical wave guide 451 is illuminated in the form of a line on a part to be cut of the crystalline ingot 3, and as shown in FIGS. 14 and 15, the part to be cut of the crystalline ingot 3, which is kept still, is removed by etching from the upper side, beyond the central axis, and to the lower side.

As with the first embodiment, the crystalline ingot 3 is inclined by a few degrees with respect to the horizontal axis H in the case where the optical guide unit 45 of this embodiment is used as well. And except that the the crystalline ingot 3 does not rotate, the control operation of the cutting apparatus in the case where the optical guide unit 45 of this embodiment is used is the same as that of the abovementioned embodiment.

Figure 16:
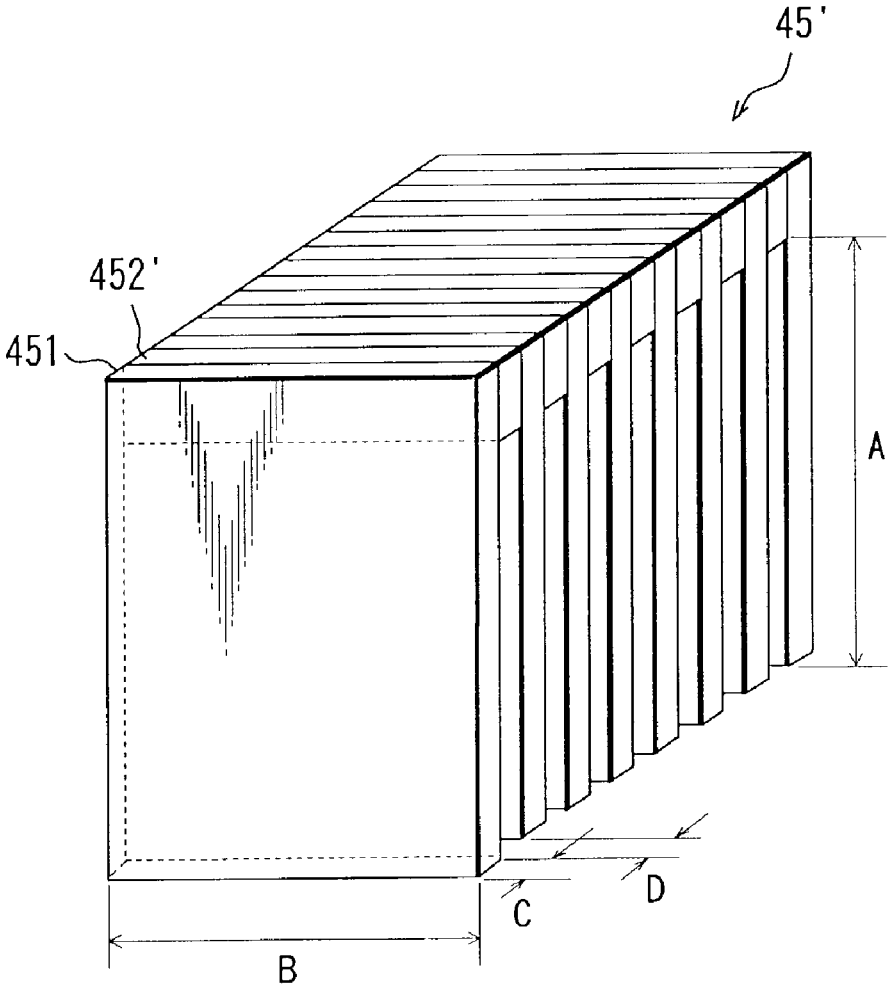
FIG. 16 is a perspective view of an optical guide unit used in an ingot cutting apparatus, which is yet another embodiment of this invention.

In place of the optical guide unit used in the embodiment shown in FIG. 13, an optical guide unit 45', which, as shown in FIG. 16, has a simple, planar shape as the shape of the lower end face of a spacer 452', may be used.

Figure 17:
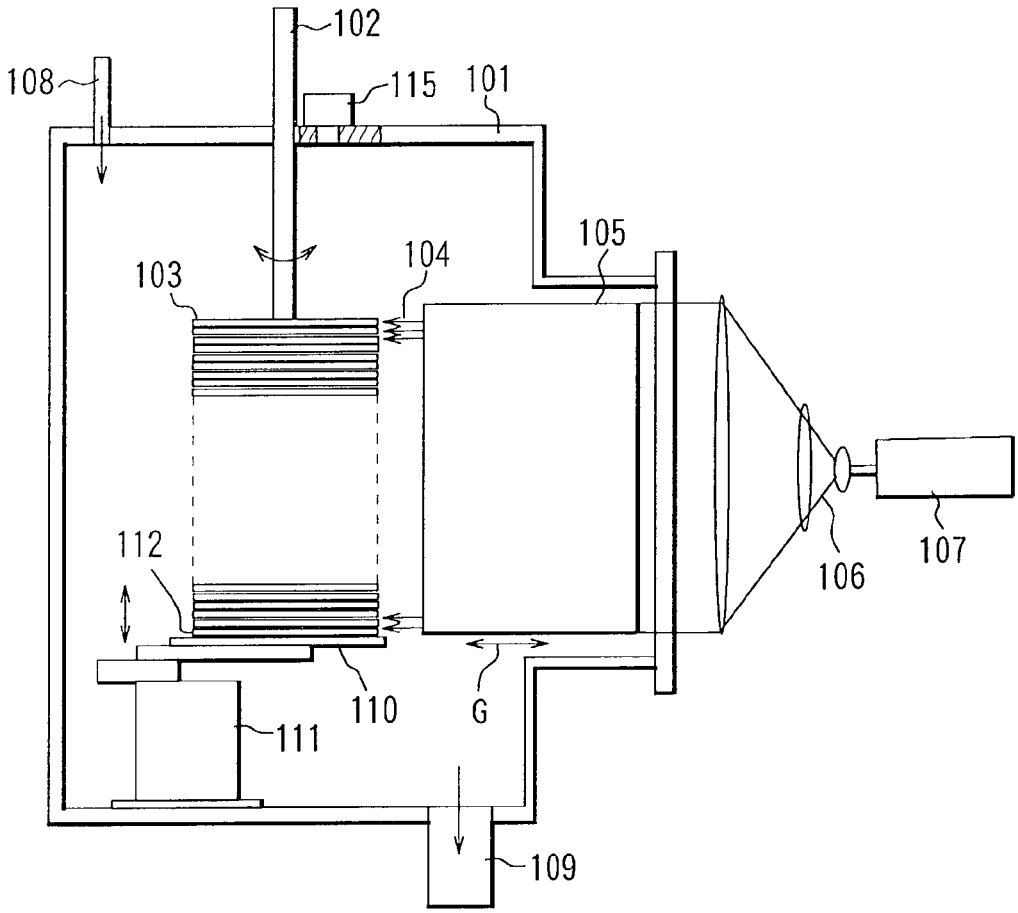
FIG. 17 is an overall arrangement diagram of an ingot cutting apparatus, which is yet another embodiment of this invention.

FIG. 17 shows the overall arrangement of an ingot cutting apparatus, which is another embodiment of this invention. Though cases where the crystalline ingot 3 is inclined by a few degrees with respect to the horizontal axis H were described with the respective embodiments above, with the present embodiment, a crystalline ingot 103 is disposed so as to extend vertically.

In FIG. 17, 101 is a chamber and an etching gas supply piping 108, for supplying etching gas into the chamber 101, is connected to the upper part of the chamber 101. Also, an exhaust piping 109, for evacuating or drawing out etching gas from the interior of the chamber 101, is connected to the lower part of the chamber 101. An unillustrated vacuum pump is connected to the exhaust piping 109.

As the etching gas, a gas comprising at least one component of $NF_3$, $CCl_2F_2$, $CF_4$, $C_2F_6$, $C_3F_8$, $CHF_3$, $CCl_4$, $SF_6$, $CCl_3F$, HCl and HF is used, and a solitary gas may be used or a mixed gas of two or more types of gases may be used.

Anti-corrosion treatment by at least one component selected from among SiC, AlN, SiN, $Al_2O_3$, $AlF_3$, FRP treatment material, and CRP treatment material is applied to parts of the inner surface of the chamber 101 that may contact the etching gas.

At a central space within the chamber 101, a crystalline ingot 103 is positioned in a state where its axis extends vertically. At the upper end of the crystalline ingot 103, a shaft 102 is mounted integrally and in a rotatable manner to the crystalline ingot 103. An unillustrated driving motor is coupled via a speed reducer, etc., to this shaft 102, and the crystalline ingot 103 can be driven to rotate about its axis by the rotation of the driving motor.

Also, at a lower space within the chamber 101 is provided a robot (handling mechanism) 111, which supports the wafers 112 that are cut out one by one from the lower end of the crystalline ingot 103 and also conveys and houses the wafers to and in an unillustrated load chuck chamber for taking out the wafers. As shown in the Figure, a hand part 110 of this robot 111 waits at a horizontal position for a wafer 112 to be cut out and supports a wafer 112, which, upon being cut, drops by a minute amount by its own weight.

The robot 111 is arranged to enable raising/lowering of hand part 110. Also, the entirety of the robot 111 can move in the horizontal direction within the chamber 101.

$N_2$, Ar, or other inert gas is supplied into the load chuck chamber, and pressure control is performed so that in the condition where the partition wall of the load chuck chamber is opened, the pressure inside the load chuck chamber will be slightly more positive than the pressure inside the chamber 101.

Furthermore, at a space at the right side within the chamber 101 is provided an optical guide unit 105, which guides the laser light 104, from a laser light source 107, onto the crystalline ingot 103. An optical guide unit 105 of the same arrangement as any of those described with above-mentioned embodiments may be used.

That is, the optical guide unit 105 is arranged with a plurality of sheet-like, bar-like, or fiber-like optical wave guides aligned in parallel at a fixed interval in the ingot axis direction (up/down direction). An optical system 106, which can make the laser light from the laser light source 107 either enter the plurality of the optical wave guides uniformly or enter a single specific optical wave guide, is disposed between the optical guide unit 105 and the laser light source 107.

Also, though not illustrated, a sliding mechanism is provided which drives the optical guide unit 105, along with the laser light source 107 and the optical system 106, in the direction of the arrow G (horizontal direction) in the Figure.

Furthermore, on the upper part of the outer surface of the chamber 101 is provided an optical detector 115 which detects the cutting depth of the crystalline ingot 103 from the exterior of the chamber and via a hole formed in the wall part of the chamber 101.

To be more specific, as the detector 115, a detector, which makes use of the transmitted light of a visible light, infrared light, etc. that has been introduced from the exterior of the chamber, a detector, which makes use of the scattered light of the laser light used for the etching of the crystalline ingot 103, or a detector, which makes use of the secondary light that is generated by the etching process, may be employed. For example, a television camera, which takes an image of the cut part of the crystalline ingot 103 by making use of such light as mentioned above, may be used.

The position of such a type of television camera is not limited to the illustrated position but is preferably a position by which an image can be taken from the side face of the crystalline ingot 103.

With the present embodiment, an excimer laser of KrF, ArF, Ar, $F_2$, etc., is used for the laser light and in terms of the oscillation method, the laser may be a pulse type or a continuous type. Also, i rays or deep UV light may be used as light from a light source, such as a mercury lamp, ultrahigh pressure mercury lamp, xenon lamp, xenon mercury lamp, deuterium lamp, etc.

The control operations of the cutting apparatus arranged in the above manner are the same as those of the cutting apparatus of the embodiment shown in FIGS. 1 to 9.

With an ingot cutting apparatus, wherein a crystalline ingot is positioned in a vertically extending manner as in the embodiment shown in FIG. 17, the crystalline ingot may be kept still and an optical guide unit that was described using FIGS. 13 and 16 may be used.

As has been described above, with each of the above-described embodiments, light from a light source is illuminated from the exit surface at the tip of a thin (sheet-like, rod-like, or fiber-like) optical wave guide onto a part to be cut of a base material, such as a crystalline ingot, or other columnar or prismatic material, as a light beam of spot-like or line-like shape, and as the cutting of the base material progresses (as the ingot component is gradually removed by volatilization from the surface of the crystalline ingot), the abovementioned thin optical wave guide can be made to enter inside the groove that is formed at the part to be cut. Light will therefore not be illuminated on the inner side surfaces of the groove and the widening of the groove can thus be avoided.

The abovementioned groove can thus be made to take on a thin slit-like form and wafers or other thin plates can be cut out from the crystalline ingot or other base material with a narrow cutting margin. The waste of the ingot or other base material can thus be kept to the minimum and the number of thin plates that can be cut out from the base material of the same size can be increased.

Also, since the exit surface of the optical wave guide can be kept constantly close to (maintained at a fixed distance from) the part to be cut, wafers and other thin plates can be cut out at high energy efficiency and yet at fixed cutting margin.

Furthermore, in the case where a plurality of the optical wave guides are positioned in parallel in the axial direction of the crystalline ingot or other base material and light is guided simultaneously to a plurality of parts to be cut of the base material to simultaneously process the plurality of parts to be cut, the necessary number of light sources can be minimized to realize a simple arrangement and low cost for the apparatus by arranging light from a single light source to be incident on the abovementioned plurality of the optical wave guides.

Also with each of the above-described embodiments, the plurality of parts to be cut of the crystalline ingot or other base material are first removed until the condition in which a predetermined removal margin is left (condition prior to being completely cut) is reached and then the removal margin part is removed (complete cutting is performed) in order from the foremost end side of the base material to cut out wafers or other thin plates one at a time. The thin plates can thereby be supported in a manner that prevents collapsing by a supporting mechanism (handling mechanism) that is simple in comparison to the case where a plurality of the thin plates that are cut out are supported simultaneously, and flawing of the thin plates and damaging of the optical wave guides can thus be prevented readily.

Moreover, since a large part of the process necessary for cutting out the plurality of thin plates is performed in a batch at first, the processing efficiency can be improved significantly in comparison to the case where thin plates are cut one at a time from the beginning.

Also, by making the intensity of the light, which is guided to the part to be cut at the foremost end side of the base material in the process of completely cutting this part to be cut, stronger than the intensity of the light, which is guided to each of the parts to be cut in the process prior to complete cutting, as in the above-described embodiments, the time required for the second process can be shortened to improve the processing efficiency further.

Also with each of the above-described embodiments, since the base material is positioned in an inclining manner and a wafer or other thin plate that is cut out tends, by its own weight, to tilt towards the lower end in the direction of inclination of the base material, the flawing of the thin plate and breakage of an optical guide member due to collapsing of the thin plate with the remaining base material or optical wave guide can be avoided.

And by providing a handling mechanism, which supports the wafer or other thin plate that tends to tilt towards the lower end in the direction of inclination of the base material by the leaning of the thin plate towards the handling mechanism, the conveying of a thin plate that has been cut out can be performed while avoiding the flawing of the thin plate, for example, due to the thin plate falling onto a horizontal supporting base.

While preferred embodiments have been described, it is to be understood that modification and variation of the present invention may be made without departing from the sprit or scope of the following claims.

What is claimed is:

1. An ingot cutting method, wherein a crystalline ingot is positioned within an etching gas and the etching gas is excited by illumination of light from a light source onto said crystalline ingot, thereby making a component of the etching gas react chemically with a component of said crystalline ingot and volatilizing the component of said crystalline ingot to cut said crystalline ingot and obtain wafers, comprising the steps of:

preparing said crystalline ingot; and guiding light from a light source to said crystalline ingot via a sheet-like, bar-like, or fiber-like optical wave guide, wherein during the cutting of said crystalline ingot, said optical wave guide and said crystalline ingot are moved relative to each other in a manner such that said optical wave guide becomes inserted into a slit formed in said crystalline ingot by volatilization of said crystalline ingot and the distance between the light exiting surface of said optical wave guide and the chemically reacting part at the cut part of said crystalline ingot is kept substantially fixed.

2. The ingot cutting method according to claim 1, wherein a plurality of said optical wave guides are aligned in parallel in the axial direction of said crystalline ingot to guide light simultaneously to a plurality of parts of said crystalline ingot.

3. The ingot cutting method according to claim 2, wherein light from a single light source is made to enter said plurality of optical wave guides.

4. The ingot cutting method according to claim 1, wherein said light from a light source is an excimer laser light.

5. The ingot cutting method according to claim 1, wherein said etching gas comprises at least one component of $NF_3$, $CCl_2F_2$, $CF_4$, $C_2F_6$, $C_3F_8$, $CHF_3$, $CCl_4$, $SF_6$, $CCl_3F$, HCl and HF.

* * * * *